United States Patent [19]

Orlando et al.

[11] Patent Number: 4,536,130

[45] Date of Patent: Aug. 20, 1985

[54] SIMPLIFIED UNLOADER INDICATOR FOR HELICAL SCREW ROTARY COMPRESSOR

[75] Inventors: Salvatore Orlando, South Windsor; David R. Martin, Torrington, both of Conn.

[73] Assignee: Dunham-Bush, Inc., West Hartford, Conn.

[21] Appl. No.: 621,653

[22] Filed: Jun. 18, 1984

[51] Int. Cl.[3] ..... F04B 21/00; G01D 11/00

[52] U.S. Cl. ..... 417/63; 417/310; 418/2; 92/33; 92/5 R; 74/57; 116/285; 62/125; 62/228.5

[58] Field of Search ..... 417/63, 280, 297, 310; 418/2; 62/125, 131, 196.1, 228.5; 116/285; 92/5 R, 31, 33; 74/57, 58

[56] References Cited

U.S. PATENT DOCUMENTS

| | | | |
|---|---|---|---|
| 1,056,616 | 3/1913 | Wright et al. | 92/33 X |
| 1,371,395 | 3/1921 | Rast | 116/285 X |
| 2,367,431 | 1/1945 | Reece | 74/57 X |
| 2,554,971 | 5/1951 | Adler | 74/58 X |
| 2,720,186 | 10/1955 | Springer | 116/285 X |
| 2,936,737 | 5/1960 | Miller | 92/31 X |
| 3,077,179 | 2/1963 | Evanson | 116/285 |
| 3,172,338 | 3/1965 | Ackerman | 92/33 X |
| 3,186,311 | 6/1965 | Carlson | 92/33 X |
| 3,408,827 | 11/1968 | Soumerai et al. | 62/228.5 X |
| 3,432,089 | 3/1969 | Schibbye | 417/310 X |
| 3,738,116 | 6/1973 | Gazda | 62/131 |
| 3,738,780 | 6/1973 | Edstrom | 417/310 X |
| 3,915,070 | 10/1975 | Mailliet | 92/33 X |
| 3,924,972 | 12/1975 | Szymaszek | 417/310 |
| 4,412,788 | 11/1983 | Shaw et al. | 417/310 X |

FOREIGN PATENT DOCUMENTS

| | | | |
|---|---|---|---|
| 2339324 | 2/1975 | Fed. Rep. of Germany | 92/5 R |
| 149950 | 8/1981 | German Democratic Rep. | 418/2 |
| 430883 | 2/1948 | Italy | 116/285 |

*Primary Examiner*—William L. Freeh
*Assistant Examiner*—Paul F. Neils
*Attorney, Agent, or Firm*—Sughrue, Mion, Zinn, Macpeak & Seas

[57] ABSTRACT

The shaft coupling a reciprocating piston of a fluid motor to a slide valve shiftable longitudinally along a screw compressor housing and varying the amount of compressor suction gas returned to the suction port for varying compressor capacity constitutes an outer hollow tube having a smaller diameter indicator shaft mounted axially therein. The shaft carriers a helical V-groove on its exterior surface and a spring biased pin projecting radially inwardly from the outer tube rides in the helical groove such that, as the slide valve reciprocates, driven by the fluid motor piston, the indicator shaft is rotatably driven about its axis. Multiple cams fixed to the indicator shaft and rotatable therewith actuate juxtapositioned microswitches to indicate full load position, full unload position, and two intermediate load positions for the slide valve. The indicator shaft is directly axially connected to a potentiometer to provide an electrical analog output signal. A rotatable dial associated with the potentiometer permits calibration of the same. The hollow outer tube appropriately serves as the liquid supply conduit for liquid refrigerant or oil which is injected into the helical screw compressor working chamber via an injection port of the slide valve which port opens to the intermeshed helical screw rotors.

5 Claims, 7 Drawing Figures

SIMPLIFIED UNLOADER INDICATOR FOR HELICAL SCREW ROTARY COMPRESSOR

FIELD OF THE INVENTION

This invention relates to unloader indicators for helical screw rotary compressors, and more particularly, to an unloader indicator of simplified construction which readily translates reciprocating slide valve motion to shaft rotary motion for effecting compressor control and analog signal output.

BACKGROUND OF THE INVENTION

U.S. Pat. No. 3,738,116 entitled "COMPRESSOR UNLOADER INDICATOR AND REFRIGERATION SYSTEM CONTROLLED THEREBY" to Edward S. Gazda and assigned to the common assignee, discloses an unloader indicator and control mechanism associated with a typical helical screw rotary compressor. The unloader indicator of that patent utilizes a rod reciprocating with a slide valve and positioned within a fixed concentric, non-magnetic tube. The rod carries a permanent magnet, and the concentric tube supports a magnetic follower which is slidably mounted on the tube in concentric fashion for free sliding movement axially on the same but constrained to follow the magnet due to the magnetic attraction between the follower and the permanent magnet fixedly mounted to the reciprocating rod. The position of the follower, therefore, is indicative of the position of the slide valve. The indicator and control system utilizes an outer fixed tube which concentrically surrounds but is spaced from the magnetic follower. This tube may be transparent to allow viewing of the follower such that an indicator scale carried by the outer tube clearly identifies the exact axial position of the follower and thus the unloader slide valve. Further, a pluralty of reed switches are mounted to or incorporated within the outer tube at spaced longitudinal positions on that tube with the reed switches changing state when the permanent magnet passes by the switches. In turn, the reed switches are electrically connected via holding relays to the solenoid operated valves associated with the hot gas bypass circuit and the liquid refrigerant feed from the superheater to the refrigeration system chiller evaporator (as an example) for controlling operation of the flow of the working fluid, in this case refrigerant, through the system and to and from the compressor.

While the unloader indicator and the refrigeration system control components forming a part of that assembly function adequately, the unloader is somewhat complicated, and there is no direct mechanical coupling between the slide valve itself and the actuator elements for effecting the change of state of the switches, raising hysteresis problems.

It is, therefore, a primary object of the present invention to provide an improved unloader indicator for a helical screw rotary compressor which is of simplified construction, provides a positive drive between the slide valve and the actuators for the screw compressor control system, and wherein an analog electrical output signal, representing displacement of the slide valve, is readily effected.

DESCRIPTION OF THE PREFERRED EMBODIMENT

Figure 1:
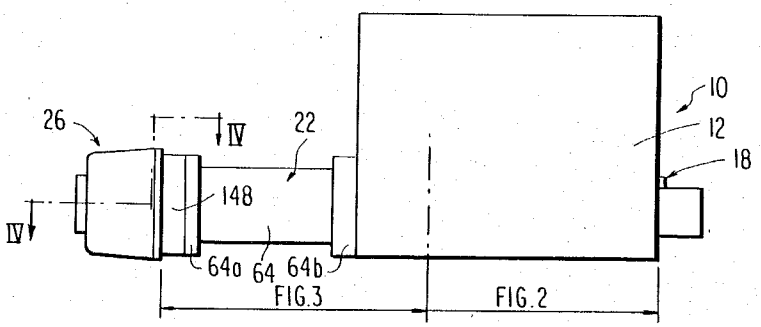
FIG. 1 is a side elevational view of a helical screw compressor incorporating an unloader indicator forming a preferred embodiment of the present invention.

The unloader indicator of the present invention and the portion of the helical screw compressor to which it is attached may be seen in FIG. 1, and the position and function of the indicator is similar to that of referred to U.S. Pat. No. 3,738,116. A helical screw rotary compressor indicated generally at 10 includes a housing 12 having a pair of laterally intersecting cylindrical bores, one of which is shown at 14, within which bores are mounted for rotation a pair of intermeshed helical screw rotors, one of which is shown at 16, and supported for rotation by shafts projecting from the ends of the rotors and mounted by bearings (not shown) in a wholly conventional manner. The compressor 10 includes an unloader slide valve indicated generally at 18 which is mounted for reciprocation within a suitable recess 19 within compressor housing 12. The slide valve 18 includes a face **18*a* which forms a part of the compression envelope including the intersecting bores 14 such that during rotation of the rotors, a working fluid such as a refrigerant in vapor or gas form is compressed while moving through the compressor 10 from a suction port 21 to a discharge port 23. The slide valve 18 is reciprocated longitudinally by operation of an unloader cylinder indicated generally at 22, comprising a hydraulic linear motor. A piston 24 reciprocates within the unloader cylinder 22 and is connected to the slide valve 18 by hollow piston rod 20 such that as the piston 24 is reciprocated by the application and removal of hydraulic fluid within the cylinder chambers to respective sides of the piston 24, the piston moves from right to left and vice versa. Movement of the slide valve 18 to the right causes the compressor 10 to unload while movement to the left, fully closing off a gap G between the end 18*b* of the slide valve 18 and end wall 12*a* of the compressor housing 12, prevents some of the suction gas from returning to the suction port 21** without being compressed. Such an arrangement is conventional and is identical to that of U.S. Pat. No. 3,738,116.

The present invention is directed to an improved unloader indicator indicated generally at 26 and comprised principally of a helically grooved indicator shaft 28 which is positioned within slide valve piston rod 20, rod 20 being in the form of a hollow tube, and a second component constituting an industrial indicator kit assembly indicated generally at 30. The kit assembly 30 may be formed of one or more of the following components: a dial readout indicated generally at 32; cam operated microswitches 34*a*, 34*b*, 34*c* and 34*d*; and a potentiometer indicated generally at 36. The number of cam operated microswitches may readily vary to meet system demands. However, the microswitches as shown function specifically under change of state indicate full load, full unload, and two partial load positions for slide valve 18. Purposely, a refrigeration system to which the invention has application and which includes appropriate solenoid operated valves and the like responsive to change of state of the microswitches, has been deleted. However, the content of U.S. Pat. No. 3,738,116 is incorporated specifically by reference herein as illustrative of a refrigeration system to which the unloader indicator has application as an element for automatically effecting a change in system operation in response to a variation in load condition on the compressor 10.

With respect to the compressor housing 12, it is closed off to the left by end wall 38. The compressor housing 12 bears recess 19 below the intermeshed helical screw rotors with the recess intersecting the cylindrical bores 14 bearing such rotors. Recess 19 is configured to the slide valve 18 such that the slide valve slides within the recess 19 with its upper face 18*a* confronting the intermeshed helical screw rotors and, as mentioned, forming a portion of the compression envelope for the gases passing into the compression chamber via the suction port 21 and exiting via discharge port 23 to the right. The slide valve 18 is a machined metal component provided with a bore at 42 and is counterbored at 44 over an extent of its length. The hollow piston rod 20 is provided with a reduced diameter portion 20*a* received by slide valve bore 42. The hollow piston rod 20 has a bore at 52 for purposes which include permitting the bore 52 of the hollow piston rod 20 to carry helically grooved shaft 28 and permitting high pressure liquid such as oil, a working fluid such as refrigerant, or the like, to flow therethrough for subsequent injection into the compression process at a closed thread defined by the intermeshed helical screw rotors. In that respect, the reduced diameter portion 20*a* of the hollow piston rod 20 includes diammetrically opposed radial passages or holes 54, and the slide valve 18 is provided with an inclined small diameter liquid injection passage 56 which leads from the counterbore 44 and an annular cavity 46 formed between counterbore 44 and the outside of the reduced diameter portion 20*a* of the piston rod 20 to the intermeshed helical screw rotors with the liquid discharging into the compression process at injection port 58. The bore 52 of the hollow piston rod 28 is closed off at the end bearing the slide valve 18 by means of an end plug 49. Further, the reduced diameter portion 20*a* of the piston rod 20 terminates in a threaded periphery as at 48 which bears a lock nut 50. Lock nut 50 bears on a lock washer 51 so as to lock the slide valve 18 to the end of the piston rod 20. To prevent rotation of the piston rod 20, the slide valve 18 may be keyed thereto by way of key slot 53 with key or pin 55 carried by the piston rod 20 and projecting into the keyway 53.

Figures 3, 3A:
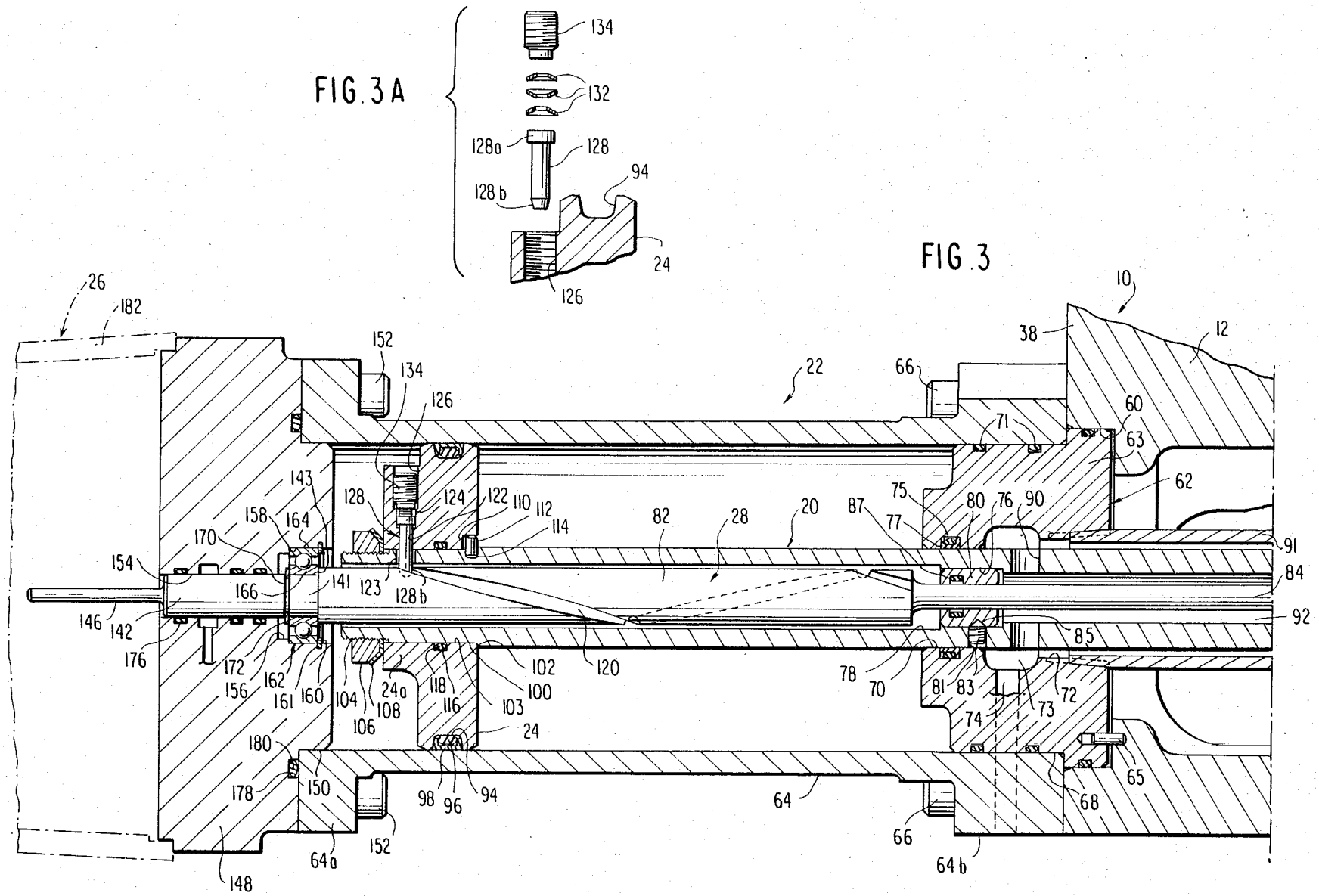
FIG. 3 is a vertical sectional view of an adjoining portion of the compressor of FIG. 1, as indicated therein.
FIG. 3A is an exploded view of the components forming a spring biased pin for rotatably driving the indicator shaft about its axis.

The unloader cylinder 22, FIG. 3, is comprised of a cylindrical body 64 having radially enlarged flanges 64*a*, 64*b* at respective left and right ends, the unloader cylinder 22 being fixedly mounted to the compressor end wall 38 via a bulkhead and tube assembly indicated generally at 62. A bulkhead 63, which is of annular form, is received within an annular recess 60 provided within the end wall 38 and is fixed in position by a dowel pin 65. The bulkhead 63 is provided with a peripheral recess 68 sized to the bore of cylindrical body 64 of the unloader cylinder 22. The flange portion 64*b* fits within recess 68 and is sealed therebetween by means of O-ring seals 71. The bulkhead 63 includes a bore 70 and a counterbore 72, the counterbore 72 forming with the hollow piston rod 20 an injection oil or liquid refrigerant gallery 73. O-ring seals 75 and cap seals 77 seal the axially slidable hollow piston rod 20 to the left of the injection oil or liquid refrigerant gallery 73. A tube 91 sized slightly larger than hollow piston rod 20 is fixed to bulkhead 63 at one end and terminates in an annular end wall 95 near housing slide valve receiving recess 19, at its opposite end to seal about sliding rod 20 via seal 93. The interior of tube 91 is in communication with gallery 73 via counterbore 72. A radial passage 74 is drilled or otherwise formed within the bulkhead 63 and tube assembly 62 starting at flange end 64*b* of the unloader cylinder body 64 and extending through bulkhead 63 to the gallery 73. This permits either oil under pressure or liquid refrigerant under pressure to enter the gallery from a source (not shown). The liquid is permitted to enter radially of the hollow piston rod 20 via diammetrically opposed passages 90, and flows through annular cavity 92 between the reduced diameter portion 84 of the helical grooved shaft 28 and the bore 52 of the hollow piston rod 20 to reach the radial passages 54 at the extreme right end of the hollow piston rod 20 and to permit liquid injection into the gas under compression by the compressor 10. The bore 52 of the hollow piston rod 20 is counterbored at 76 and further at 78 in a manner such that a bushing 80 may be fixedly mounted within counterbore 76 and about the reduced diameter portion 84 of the helical grooved shaft 28.

A tapped hole 81 within the hollow piston rod 20 bears a threaded locking screw 83 whose pointed end is received within a conical recess 85 of bushing 80 so as to lock the bushing 80 in position. The bushing 80 includes an O-ring seal 87 for sealing off chamber 92 from large diameter portion 82 of the helical grooved shaft 28 which bears helical groove 120. A number of cap screws 66 extend through the unloader cylinder body flange 64*b* and are received by tapped holes (not shown) within end wall 38 to mount the unloader cylinder 22 to the compressor 10.

The unloader piston indicated generally at 24 may be formed of metal, is of modified disc shape, and includes an annular groove 94 within its periphery. An O-ring seal as at 96 lies within groove 94, inwardly of an annular Teflon cap seal 98 which contacts the inside of cylindrical body 64 to effectively seal chambers on opposite sides of the piston selectively receiving and being relieved of hydraulic fluid and acting to cause reciprocation of the piston and the slide valve 18 between full load and full unload position, and vice versa. The hollow piston rod 20 is provided with a peripheral recess at 100 forming a radial shoulder at 102 which acts as a stop for the piston 24 against which it abuts, the piston 24 having an axial hole or bore 103 of like diameter. Piston rod 20 is provided with a radial hole 114 within which is positioned a key 112 which projects radially outwardly of the hollow piston rod and is received within a keyway or slot 110 within piston 24 to prevent rotation of the piston 24 on the piston rod 20. The outer periphery of the piston rod 20 is further reduced at its extreme left end, and is threaded as at 104 to threadably received a lock nut 106. A lock washer 108 lies between the lock nut 106 and the piston 24, and lock nut 106 locks the piston 24 to the hollow piston rod 20.

A very important aspect of the present invention involves the transforming of the reciprocating motion of the slide valve 18 into rotary motion of indicator shaft 28 without backlash and eliminating any hysteresis effect to insure accurate indication of slide valve position for slide valve 18 as well as for controlling the operation of the refrigeration, air conditioning, or compressed air or other compressed gas system to which the compressor is connected as one element of an open or closed compression gas loop. In that respect, in addition to the helical groove 120 on indicator shaft 28 which has a V-shaped cross-sectional configuration, the motion converting means comprises an indicator pin, indicated generally at 128, fixedly borne by the piston 24 and movable longitudinally with the piston and its piston rod 20. Indicator pin 128 includes a tapered or frustoconical radially projecting end **128*b* which is received within the V-shaped groove 120 so as to contact the V-shaped cross-section helical groove 120 via point contact at opposite sides therewith and to effect shaft rotation during longitudinal movement of the unloader piston and the indicator pin 128 borne thereby. To achieve this, a radial hole 122 is drilled or otherwise formed within the piston 24 which hole 122 is counterbored at 124, and at 126. Counterbore 126 is tapped. This permits indicator pin assembly components to be axially inserted in order, FIG. 3A, starting with indicator pin 128, a number of Belleview washers at 132 and a threaded set screw 134. Headed end 128*a* of indicator pin 128 and the Belleview washers 132 are received within counterbore 124, while the set screw 134 is threaded within tapped hole 126**.

The axial length of the indicator pin 128 from head **128*a* inward to frustoconical tip 128*b* is such that when tip 128*b* is passed through a hole 123 of considerably larger diameter within hollow piston rod 20, the frustoconical tip 128*b* of the indicator pin 128 rides within the V-shaped cross-section of helical groove 120 under light pressure as provided by Belleview washers 132. Thus, the indicator pin 128 located in the hub 24*a* of piston 24 and passing through the hollow piston rod 20 engages the helical groove 120 of the helical grooved indicator shaft 28 provides a very effective means for converting the linear motion of the slide valve 18 to rotary motion of the inner shaft 28. To facilitate rotation of shaft 28 at the left end, the cylindrical body 64 is closed off by a disc-shaped unloader cover 148. The cover 148 is provided with peripheral recess 150 which fits to cylindrical body flange 64*a*, at that end, and a series of cap screws 152 projecting through the flange 64*a* are received within tapped holes (not shown) within the unloader cover 148. An annular groove 178 within the axial end face of the unloader cover 148 receives O-ring 180 so as to provide a gas tight seal between the unloader cover 148 and cylindrical body 64. The unloader cover 148 is provided with a bore at 154 and counterbores 156 and 158 such that an antifriction bearing indicated generally at 162 may be fixedly mounted to the unloader cover and rotatably support the helical grooved shaft 28 at that end. Shaft 28 is provided, at its left end, with a first reduced diameter portion 141 forming a radial shoulder 143 and a second reduced diameter portion 142. Portion 142 includes an annular slot 170 within its periphery, slot 170 receiving a circlip 172 which locks the antifriction bearing 162 axially between the circlip 172 and shoulder 143 via inner race 166** of the antifriction bearing.

The ball bearing outer race 164 is physically locked by internal retaining ring 160 received within annular slot 161. The internal retaining ring 160 may also be a circlip. As such, along with the bushing 80, the antifriction bearing 162 insures relatively low friction rotation of indicator shaft 28 about its axis, but prevents the shaft 28 from shifting along its axis during such rotation. Shaft 28 terminates at its left end in a further reduced diameter end or terminal portion 146 which projects axially beyond the end of unloader cover 148.

Appropriately, radial grooves or slot are formed within bore 154 of the unloader cover 148 where bear O-rings as at 176 to prevent the loss of hydraulic fluid from the unloader cylinder 22 at that end.

Figure 4:
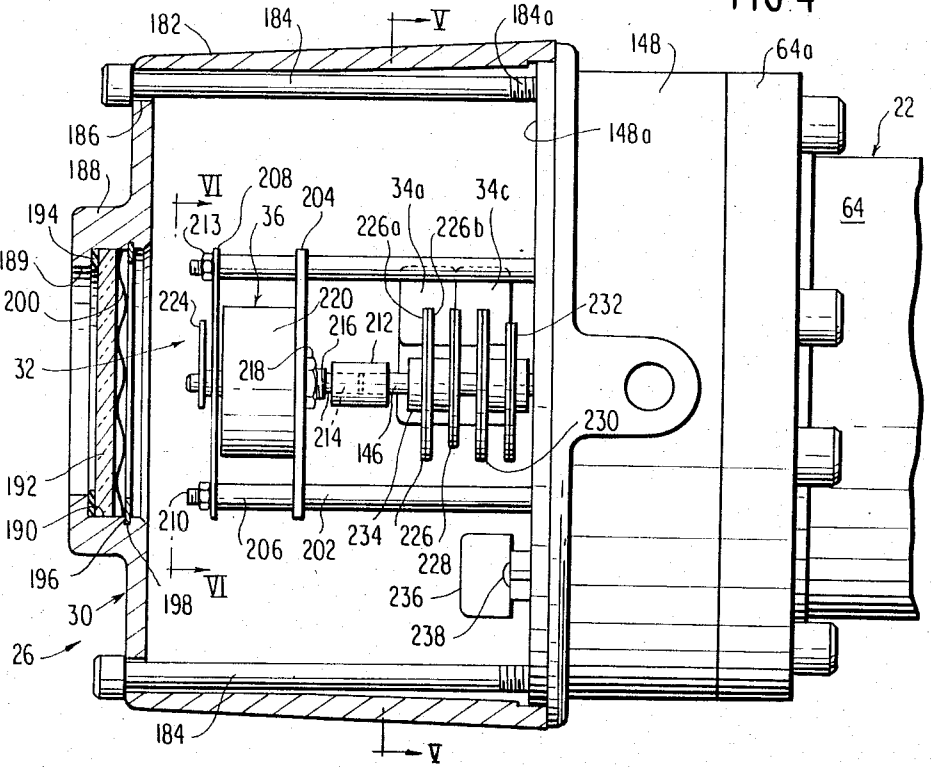
FIG. 4 is a sectional view of a portion of the unloader indicator taken about lines IV—IV of FIG. 1.

In addition to axially shortening the unloader indicator portion of the compressor in contrast to the prior art, industrial indicator assembly 30, FIG. 4, comprises an assembly which is variable in terms of its internal structure, such that it may include one or more of the following: a plurality of microswitches and their adjustable cam actuators, a potentiometer for providing an output analog electrical signal indicative of slide valve position and the capacity of the machine, and a visual indicator, all of which occupy less space than the comparable linear indicator or potentiometer of known systems.

In that respect, the industrial indicator assembly 30 is physically mounted to the exposed end of the unloader cover 148, functions as an extension of the same, and makes use of the reduced diameter terminal portion 146 of the helical grooved indicator shaft 28.

The industrial indicator kit assembly 30 components mount directly to exposed outer end face **148*a* of the unloader cover 148. Cup-shaped cover assembly 182 mounts to end face 148*a* by means of cover bolts 184 whose threaded ends 184*a* are received by tapped holes. The cover assembly 182 includes an annular flange 188 at its center, which flange includes a large diameter opening 189, opening internally and being recessed as at 190. Mounted within recess 190 is a clear glass or plastic window 192 of a diameter corresponding to that of recess 190. An annular seal 194 is sandwiched between the glass and the end of recess 190 within flange 188. The window is held in place by spring 200 backed by a circlip 196. Circlip 196 is carried within an annular slot 198 of the cover flange 188. The cover assembly 182 is therefore removable by loosening the cover bolts 184, thus permitting access to the interior of the industrial indicator assembly 30**.

Further mounted to unloader cover 148 are a number of threaded rods 210 which project longitudinally of the assembly 30 and outwardly from plate 148, and as illustrated, each passing initially through long stand-off 202 in the form of a hollow tube whose internal diameter is in excess of that of the threaded rod 210, and thence through short stand-off 206, of matching diameter. A potentiometer mounting plate 204 is sandwiched between the ends of the short stand-offs 206 and the long stand-offs 202 and maintained in place by the threaded rod 210 which projects through holes of similar size within the potentiometer mounting plate 204. At the opposite end of the short stand-offs 206, a dial readout plate 208 extends across and between the multiple threaded rods 210 with their ends projecting through holes within plate 208. Nuts 213 threaded to the rods 210 maintain this stacked array in position. The reduced diameter terminal portion 146 of the helical grooved shaft 28, projecting outwardly from the unloader cover 148, extends towards the potentiometer mounting plate 204, but terminates short thereof. The potentiometer mounting plate 204 mounts potentiometer 220. Potentiometer 220 bears a shaft 214 which projects through a threaded bushing 216, about which is provided a lock nut 218 for locking the potentiometer 220 against and onto the front of the potentiometer mounting plate 204, with the lock nut 218 bearing against the rear of that plate. Shaft 214 for the potentiometer is coupled to the helical grooved shaft 28 via coupling 212. Coupling 212 may comprise a flexible tube with friction fits to shaft 214 and indicator shaft terminal portion 146. This permits rotation of the potentiometer shaft 214 irrespective of slight axial misalignment relative to shaft portion 146 of the helical groove shaft 28. Shaft 214 extends past and through the dial readout plate 208.

Figure 6:
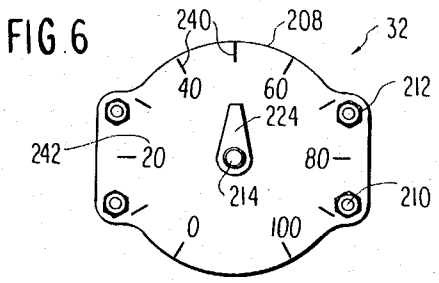
FIG. 6 is an end view of the unloader indicator dial plate taken about line VI—VI of FIG. 4.

By reference to FIG. 6, it may be seen that internally of window 192 and behind cover 182, a determination of compressor capactiy and the position of the slide valve may be visually ascertained by viewing the angular position of a rotatable indicator needle or hand 224 which is fixed to the end of the potentiometer shaft 214 projecting through a hole within the dial readout plate 208. In that respect, scale marks 240 are provided on the dial readout plate 208 along with numerical indicia as at 242 identifying the percentage of load on the compressor 10. The indicator needle 224 rotates counterclockwise, as seen in FIG. 6, to indicate that the capacity of the compressor is decreasing. The slide valve, in shifting from right to left, causes the indicator needle 224 to rotate clockwise towards full load position. As may be appreciated, a rotation of approximately 300 degrees occurs as the slide valve 18 shifts from full load to full unload position, or vice versa.

Figure 5:
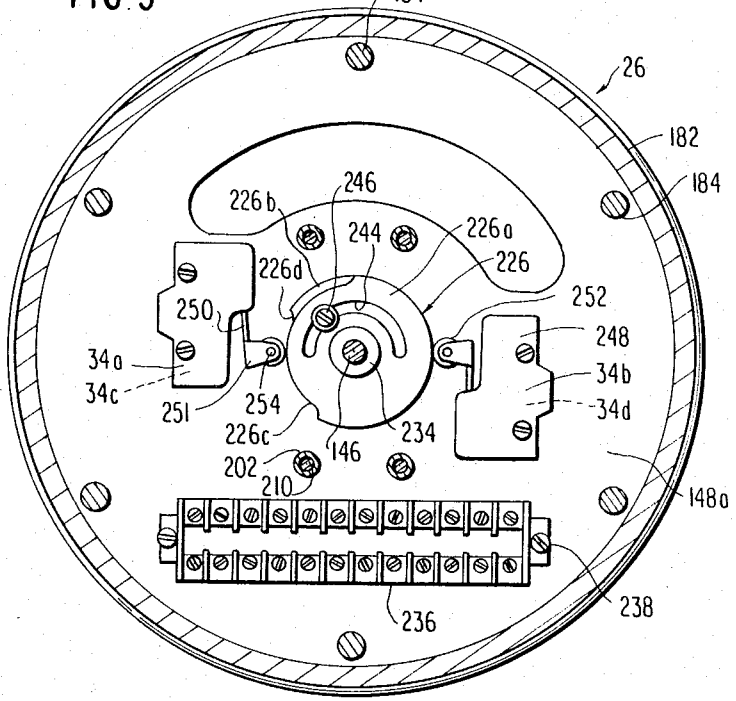
FIG. 5 is a vertical sectional view of the portion of the unloader indicator of FIG. 4 taken about line V—V.
Figure 2:
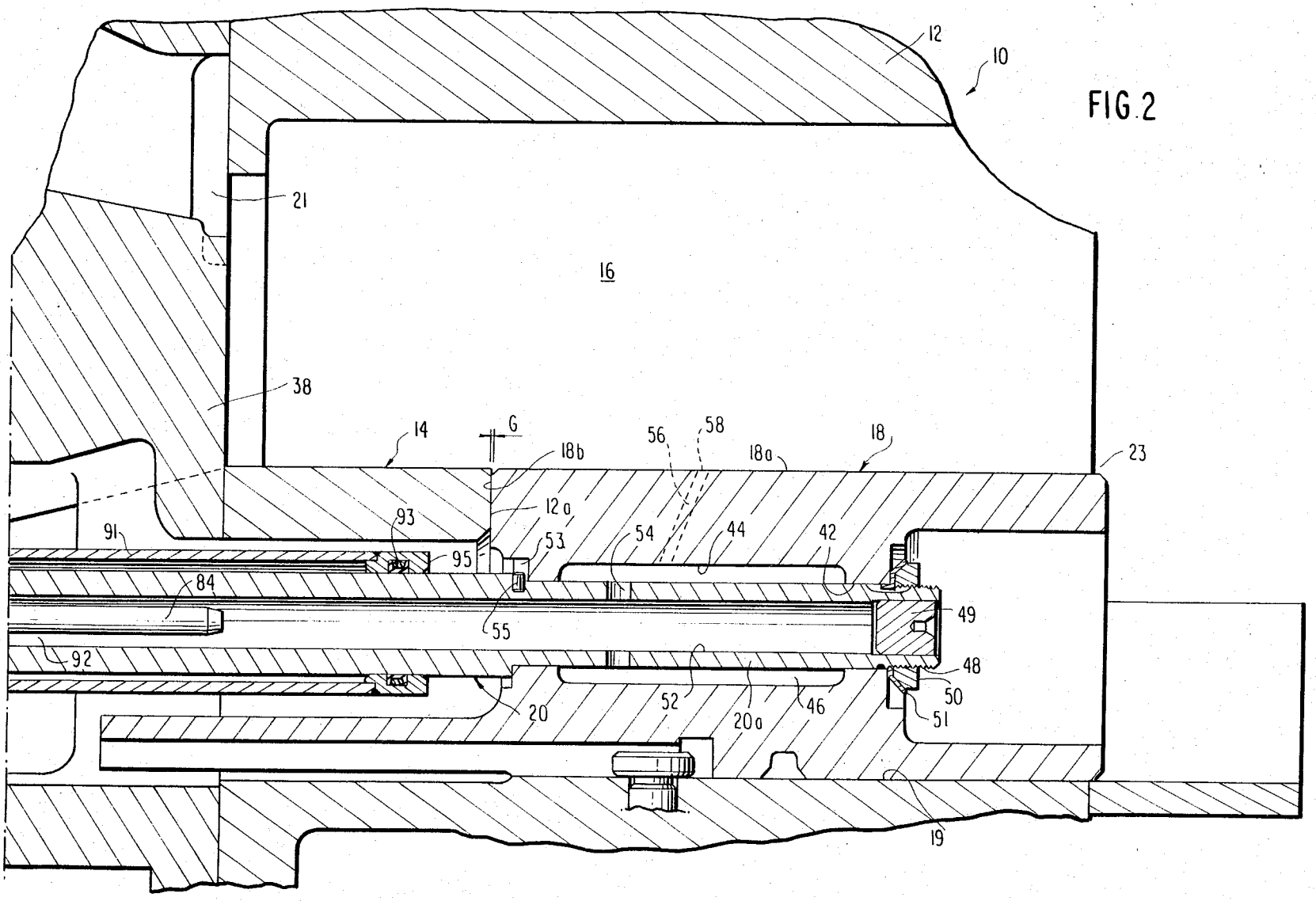
FIG. 2 is a vertical sectional view of one portion of the compressor of FIG. 1, as indicated therein.

In the compact industrial indicator assembly 30, means are provided for effectively controlling certain components of the gas compression system to which the helical screw rotary compressor has application as, for instance, a refrigeration or air conditioning system. In that respect, there is mounted directly to reduced diameter portion 146 of the helical grooved shaft 28, individual adjustable cams as at 226, 228, 230 and 232, in order, from the potentiometer 220 axially towards the slide valve 18. As seen within FIGS. 4 and 5, each of the adjustable cams comprise two face abutting discs. In FIG. 5, the axially outermost cam 226 is shown as mounted to shaft portion 146 via collar 234 fixed to one cam disc **226*a*, at its center, through which the shaft 146 projects. A set screw 246 permits adjustable cam disc 226*b* (behind disc 226*a*) to be rotatably adjusted relative to the shaft to vary the angular position of rearmost disc 226*b*. Behind disc 226*a* lies the second disc 226*b*, and the outer disc 226*a* carries an arcuate slot 244 through which projects adjusting screw 246. The screw 246 may be loosened so as to permit the disc 226*b* to be rotated about its axis on shaft 146 to a position so its cam recess portion 226*d* adjusts relative to the recessed portion 226*c* of the outer disc 226*a*. Thus, by rotating the rear disc 226*b* relative to the outer disc 226*a*, FIG. 5, the circumferential extent of the peripherally recessed portion of the composite adjustable cam 226** may be varied to suit conditions.

The various cams as at 226, 228, 230 and 232 are positioned axially on shaft 146 at positions such that their peripheries interact with a given microswitch. For the four adjustable cams 226, 228, 230 and 232, in FIG. 5, only two microswitches as at **34*a* and 34*b* are shown, although identical microswitches are each provided to the rear of microswitches 34*a* and 34*b*, respectively, and contact others of the adjustable cams. For instance, microswitch 34*a* is associated with the adjustable cam 226, while in FIG. 5, microswitch 34*b* is located in the plane such that its actuator roller or cam follower 252 is in the plane of the second axial cam 228 of the series of cams. In each case, however, for each of the microswitches 34*a*, 34*b*, 34*c* and 34*d*, the microswitches comprise switch bodies 248, and have projecting therefrom on the sides facing the cams, an actuator lever as at 250 which is spring biased outwardly and having at the free end by way of a suitable bracket 251, a roller 252 mounted to the bracket on an axle or pin 254. The rollers act as cam followers and bear on the perphery of the adjustable cams so as to ride on the outer peripheries except at the portions where the recesses notch. This is seen by the angular relationship between the recesses 226*c*, 226*d* for cam discs 226*a* and 226*b* of adjustable cam 226, in FIG. 5**, and is representative of all four of the adjustable cams and their microswitches.

Appropriately, a terminal block 236 is shown as being mounted to the end face of end cover 148 beneath the lower two of the stand-offs 202 and spanning across the end cover, and being mounted thereto by way of mounting screws 238. The terminal block permits electrical connections to the microswitches as at **34*a*, 34*b*** on one side of the block, and from the terminal block to electical apparatus such as solenoid operated valves within the refrigeration, air conditioning systems, etc., to which the unloader has application.

In operation, during the running of the compressor, the supply of hydraulic fluid to a given side of the reciprocating piston 24 causes the slide valve 18 to shift towards and away from the end of its recess, the gap between the slide valve 18 and the compressor casing forming a return passage for the gas back to the suction side of the compressor, thereby unloading the screw compressor. During reciprocation of the hollow piston rod, the indicator shaft 28 mounted therein for rotation about its axis, but prevented from shifting axially, is driven in rotation by the indicator pin 128 which projects radially inwardly from the hub of the piston and is received within a helical groove borne by the shaft periphery. This converts the linear motion of the slide valve 18 to rotary motion of the indicator shaft 28. Rotation of the indicator shaft 28 effects rotation of four fully adjustable cams which operate four microswitches indicative, respectively, of full load slide valve position, full unload slide valve position, and two intermediate load positions of the compressor. Further, the helical grooved rotary shaft 28 during rotation varies the output potential of the potentiometer operatively coupled thereto by a flexible coupling to provide an electrical analog signal indicative of slide valve position. The other end of the potentiometer shaft has attached needle or hand 224 as a visual indicator showing the relative load/unload position of the compressor slide valve through a clear glass window for ascertaining slide valve relative position at a glance.

As may be appreciated, since the pin contacts the helical groove of V-shaped cross-section by point contact at opposite sides of the frustoconical tip of the pin, hysteresis type loses are reduced to a minimum by virtually eliminating backlash within the helix drive mechanism. The system is highly compatible with pneumatic control systems and is accomplished by removal of the electrical components and the addition of pneumatic control valves. The improved analog output control signal is virtually noiseless because of the use of a conductive plastic potentiometer, and the system employs truly repeatable switching due to the mechanical drive via the cams from the rotating indicator shaft to the microswitches mounted adjacent to that shaft. A simplified, more compact arrangement results wherein the microswitches, potentiometer and visual indicator occupy less space than comparable linear indicators or potentiometers as employed in the past. Switch position settings are simplified by the addition of fully adjustable cams providing increased accuracy of switch change of state. Misalignment problems virtually disappear because the entire assembly and slide valve have a common center, and some misalignment axially may be tolerated between the potentiometer shaft and the helical grooved indicator shaft borne internally of the hollow slide valve. Field damage is reduced to a minimum due to the much more rigid assembly housing, and thus the industrial indicator assembly is less vulnerable to field damage.

Importantly, the industrial indicator assembly 30 constitutes a unit which is readily completely removable from the compressor and its slide valve hydraulic cylinder. The industrial indicator assembly is in essentially kit form permitting the utilization of any one or all of microswitches, potentiometer and visual indicator.

While the invention has been particularly shown and described with reference to a preferred embodiment thereof, it will be understood by those skilled in the art that various changes in form and details may be made therein without departing from the spirit and scope of the invention.

What is claimed is:

1. In a helical screw rotary compressor for a gas compression system, said compressor having:

an axially shiftable unloader slide valve for varying the capacity of the compressor, an unload cylinder mounted to said compressor and including a reciprocating piston and defining with said cylinder fluid sealed chambers on opposite sides of said piston, a piston rod mounted to said piston at one end and mounted to said slide valve at the other end;

whereby the application and removal of a compressed fluid to and from said chambers causes said piston to reciprocate said slide valve between full load and full unload positions and vice versa, the improvement wherein:

said piston rod is hollow, and wherein said compressor further comprises an indicator shaft positioned coaxially within said hollow rod, means for mounting said indicator shaft for rotation about its axis and for preventing shaft axial movement, an indicator pin fixedly mounted to one of said rod and said shaft and extending radially therefrom, a helical groove formed within the other of said rod and shaft, facing said pin and receiving a radially projecting portion of said pin, means operatively engaging said indicator shaft and responsive to rotation of said indicator shaft for at least indicating the position of the slide valve and the load/unload condition or said compressor, and wherein said compressor further comprises; a compressor housing, parallel bores formed within said housing for receiving intermeshed helical screw rotors, a recess within said housing opening to said bores, said slide valve being positioned within said recess for reciprocating movement therein, a bulkhead closing off one end of said unload cylinder, a bore within said bulkhead slidably and sealably receiving said hollow piston rod to permit reciprocation of said rod within said bulkhead bore, a counterbore within said bulkhead defining a high pressure injection liquid gallery for permitting high pressure liquid to be fed to the gallery, a bushing fixedly carried internally of said hollow piston rod at said bulkhead and rotatably mounting said indicator shaft, said shaft being of a diameter less than the internal diameter of the hollow piston rod, at least one radial hole extending through said hollow piston rod, a cylindrical tube concentrically surrounding said hollow piston rod and being fixed at one end to said bulkhead and being sealed at its opposite end to said hollow piston rod, terminating at that end in proximity to said slide valve bearing recess of said compressor housing and being open internally to said gallery such that irrespective of axial position of the slide valve, the high pressure injection liquid for feeds from the gallery through the interior of said hollow piston rod between said bushing and said slide valve, and fluid passage means through said hollow rod and said slide valve, and opening to an injection port on the face of the slide valve proximate to said rotor receiving bores of said compressor housing; whereby, liquid injection can take place within the compression process, sealed from the chamber to the side of the unload cylinder piston proximate to said slide valve.

2. In a helical screw rotary compressor for a gas compression system, said compressor having:

an axially shiftable unloader slide valve for varying the capacity of the compressor, an unload cylinder mounted to said compressor and including a reciprocating piston and defining with said cylinder fluid sealed chambers on opposite sides of said piston, a piston rod mounted to said piston at one end and mounted to said slide valve at the other end;

whereby the application and removal of a compressed fluid to and from said chambers causes said piston to reciprocate said slide valve between full load and full unload positions and vice versa, the improvement wherein:

said piston rod is hollow, and wherein said compressor further comprises an indicator shaft positioned coaxially within said hollow rod, means for mounting said indicator shaft for rotation about its axis and for preventing shaft axial movement, an indicator pin fixedly mounted to one of said rod and said shaft and extending radially therefrom, a helical groove formed within the other of said rod and shaft, facing said pin and receiving a radially projecting portion of said pin, means operatively engaging said indicator shaft and responsive to rotation of said indicator shaft for at least indicating the position of the slide valve and the load/unload condition or said compressor, and wherein said unloaded cylinder piston includes a radial bore, said hollow piston rod includes a bore aligned therewith, said piston further comprises first and second counterbores radially outwardly of said bore, said indicator shaft includes a helical groove on its outer periphery, said pin comprises a shank, is headed at one end and terminates in a conical tip at said other end, said shank of said pin being slidably positioned within said piston bore, said tip projecting through a radial bore within said hollow piston rod and being received within said helical groove of said indicator shaft, said helical groove being V-shaped in cross-section such that said conical tip makes point contact on opposite sides of said V-shaped helical groove, said second counterbore being tapped, Bellevue washers positioned within said first counterbore, and in contact with the headed end of said pin, and a set screw being threaded into said tapped second counterbore so as to compress said Bellevue washers and provide light spring bias of said pin against the walls of the V-shaped helical groove of said indicator shaft.

3. In a helical screw rotary compressor for a gas compression system, said compressor having:

an axially shiftable unloader slide valve for varying the capacity of the compressor, an unload cylinder mounted to said compressor and including a reciprocating piston and defining with said cylinder fluid sealed chambers on opposite sides of said piston, a piston rod mounted to said piston at one end and mounted to said slide valve at the other end;

whereby the application and removal of a compressed fluid to and from said chambers causes said piston to reciprocate said slide valve between full load and full unload positions and vice versa, the improvement wherein:

said piston rod is hollow, and wherein said compressor further comprises an indicator shaft positioned coaxially within said hollow rod, means for mounting said indicator shaft for rotation about its axis and for preventing shaft axial movement, an indicator pin fixedly mounted to one of said rod and said shaft and extending radially therefrom, a helical groove formed within the other of said rod and shaft, facing said pin and receiving a radially projecting portion of said pin, means operatively engaging said indicator shaft and responsive to rotation of said indicator shaft for at least indicating the position of the slide valve and the load/unload condition or said compressor, and wherein said unloader cylinder terminates at its end remote from said slide valve in an unloader end cover which sealably closing off that end of the cylinder and extending transversely thereof, and wherein said indicator shaft includes a terminal portion sealably projecting through said end cover axially beyond the outside face of said end cover, at least one adjustable rotary cam is fixedly mounted to said indicator shaft extension portion for rotation therewith, and wherein said means operatively engaging said indicator shaft and responsive to rotation thereof for at least indicating the position of said slide valve and the load/unload condition of said compressor, comprises a cam operated switch mounted in juxtaposition to said at least one rotary adjustable cam, said switch including a cam follower operatively engaging the periphery of the rotary cam and functioning in response to rotation of said indicator shaft and the configuration of said rotary cam periphery for changing the state of said switch to facilitate control of the compressed gas system, and wherein said at least one adjustable cam comprises a first disc including a cylindrical collar at its center through which the terminal portion of said indicator shaft projects, means for fixing said collar to said shaft, and wherein said adjustable cam comprises a second face abutting disc freely movable on said shaft in full abutment with said first disc, and wherein an arcuate slot is formed within one of said discs, and a screw projects through said slot and is threaded into the other of said discs; whereby, loosening said screw permits the freely rotatable disc to be rotated about said shaft relative to said disc which is fixed to said shaft by said collar for angular adjustment therebetween prior to retightening said screw, and wherein both said discs include peripheral cutouts over a portion of their periphery such that by rotating the discs there is an increase or decrease in the circumferential extent of said cutouts to provide a varying cam configuration thereto.

4. In a helical screw rotary compressor for a gas compression system, said compressor having:

an axially shiftable unloader slide valve for varying the capacity of the compressor, an unload cylinder mounted to said compressor and including a reciprocating piston and defining with said cylinder fluid sealed chambers on opposite sides of said piston, a piston rod mounted to said piston at one end and mounted to said slide valve at the other end;

whereby the application and removal of a compressed fluid to and from said chambers causes said piston to reciprocate said slide valve between full load and full unload positions and vice versa, the improvement wherein:

said piston rod is hollow, and wherein said compressor further comprises an indicator shaft positioned coaxially within said hollow rod, means for mounting said indicator shaft for rotation about its axis and for preventing shaft axial movement, an indicator pin fixedly mounted to one of said rod and said shaft and extending radially therefrom, a helical groove formed within the other of said rod and shaft, facing said pin and receiving a radially projecting portion of said pin, means operatively engaging said indicator shaft and responsive to rotation of said indicator shaft for at least indicating the position of the slide valve and the load/unload condition or said compressor, and wherein said unloader cylinder terminates at its end remote from said slide valve in an unloader end cover which sealably closing off that end of the cylinder and extending transversely thereof, and wherein said indicator shaft includes a terminal portion sealably projecting through said end cover axially beyond the outside face of said end cover, at least one adjustable rotary cam is fixedly mounted to said indicator shaft extension portion for rotation therewith, and wherein said means operatively engaging said indicator shaft and responsive to rotation thereof for at least indicating the position of said slide valve and the load/unload condition of said compressor, comprises a cam operated switch mounted in juxtaposition to said at least one rotary adjustable cam, said switch including a cam follower operatively engaging the periphery of the rotary cam and functioning in response to rotation of said indicator shaft and the configuration of said rotary cam periophery for changing the state of said switch to facilitate control of the compressed gas system, said compressor further comprising a plurality of threaded rods projecting outwardly of said unloader cover about said indicator shaft terminal portion and axially beyond the same, a potentiometer mounting plate fixedly mounted to said threaded rods, perpendicular to said terminal portion and across the same, an analog readout potentiometer mounted to said potentiometer mounting plate, said potentiometer including a rotatable shaft projecting outwardly thereof extending through said potentiometer mounting plate and being in general axial alignment with the terminal portion of said indicator shaft, and coupling means coupling said terminal portion of said indicator shaft to said potentiometer shaft for effectively driving said potentiometer to provide an analog electrical signal indicative of slide valve position and unload/-load condition of the compressor.

5. The compressor as claimed in claim 4, wherein said threaded rods carry concentrically thereabout inwardly of said potentiometer mounting plate, respective long tubular standoffs for defining the longitudinal position of said transversely extending potentiometer mounting plate, said threaded rods carry, outwardly of said potentiometer mounting plate, short tubular standoffs concentrically thereon, a dial readout plate extends across and between said threaded rods through which said threaded rods project with said dial readout plate in contact with the ends of said short standoffs remote from said potentiometer mounting plate, and wherein said potentiometer shaft extends axially outwardly of and through said dial readout plate and fixedly bears an indicator needle rotatable therewith, and wherein said dial readout plate carries scale marks indicative of slide valve position and unload/load condition of said compressor.

* * * * *